US005533856A

United States Patent [19]

Friesen et al.

[11] Patent Number: 5,533,856

[45] Date of Patent: Jul. 9, 1996

[54] COMBINED LOADED SELF-LEVELING AND IMPLEMENT TILT LINKAGES FOR EFFECTING TRUE LEVEL AND ENHANCED ROLL BACK AND DUMP CHARACTERISTICS THROUGHOUT LIFT RANGE OF LOADER

[75] Inventors: Henry Friesen, Niagara Falls; Ken K. Oka, St. Catharines, both of Canada

[73] Assignee: Deere & Company, Moline, Ill.

[21] Appl. No.: 445,807

[22] Filed: May 22, 1995

[51] Int. Cl.[6] ..... E02F 3/42

[52] U.S. Cl. ..... 414/711; 414/917

[58] Field of Search ..... 414/686, 697, 414/917, 700, 706–708, 710, 711

[56] References Cited

U.S. PATENT DOCUMENTS

| | | | |
|---|---|---|---|
| Re. 29,197 | 5/1977 | Mathew et al. | 414/697 |
| 2,978,124 | 4/1961 | Bernotas | 414/711 X |
| 3,061,117 | 10/1962 | Kruse | 414/711 X |
| 3,080,076 | 3/1963 | Randall | 414/694 |
| 3,767,075 | 10/1973 | Leverenz | 414/917 X |
| 4,046,026 | 9/1977 | Hammarstrand | 414/697 |
| 4,674,944 | 6/1987 | Addleman | 414/706 X |
| 4,964,778 | 10/1990 | Muto et al. | 414/700 |
| 5,135,347 | 8/1992 | Kaczmarczyk et al. | 414/686 |
| 5,150,999 | 9/1992 | Dugan | 414/706 X |
| 5,238,357 | 8/1993 | Patrick et al. | 414/697 X |
| 5,387,076 | 2/1995 | Fuzzer | 414/686 |

*Primary Examiner*—David A. Bucci

[57] ABSTRACT

A front-end loader includes a pair of loader arms and features a parallelogram-shaped plate assembly associated with each arm and having first and second corners respectively pivotally mounted to the forward end of a respective loader arm and to an implement carrier holder and having third and fourth corners respectively pivotally coupled to levelling and tilt linkage assemblies. A tilt cylinder is mounted between the tilt linkage assembly and the parallelogram-shaped plate assembly. The parallelogram-shaped plate assembly serves to transfer levelling linkage and tilt cylinder inputs to an implement carrier holder coupled to a mounting bracket at the rear side of a bucket.

7 Claims, 2 Drawing Sheets

COMBINED LOADED SELF-LEVELING AND IMPLEMENT TILT LINKAGES FOR EFFECTING TRUE LEVEL AND ENHANCED ROLL BACK AND DUMP CHARACTERISTICS THROUGHOUT LIFT RANGE OF LOADER

BACKGROUND OF THE INVENTION

Front-end loaders are often provided with self-leveling linkages which extend between the support mast or post for the loader boom and the tilt linkage of the implement attached to the forward end of the loader boom. A common known linkage arrangement is to use the attachment tilt cylinder as one of the links in the leveling linkage. One of the drawbacks of these arrangements is that the geometry of the linkage for true leveling is obtained only for a given length of the tilt cylinder and thus for a given roll back position. If the linkage is designed to ensure sufficient roll back for all heights, then the dump angle is apt to be less than desirable at some height. Or, on the other hand, if the linkage is optimized for dump angle capability, then the roll back angle capability is apt to be unfavorable, i.e., either too great or to small, for some heights. A further drawback of using the tilt cylinder as one of the leveling linkage links is that the cylinder is oriented such that pressure is applied to the rod end to effect roll back and pressure is applied to the head end to effect dumping, thus, desired maximum roll back power and maximum dump speed is sacrificed.

A known loader marketed as the B3515 Drive-in Loader by Bomford & Evershed Ltd., a company located in Great Britain, incorporates a leveling and tilt linkage arrangement wherein an attachment holder and triangular plate assembly share a common pivot connection with the forward end of the loader boom with the leveling linkage being attached to one corner of the plate assembly and the tilt cylinder being attached between the other corner of the plate assembly and the holder such that true leveling occurs for all positions of the tilt cylinder. While this design provides a suitable roll back angle of about 40° from the horizontal, it still suffers the drawbacks of having a maximum dump angle of only about 60° from the horizontal and of not having the cylinder oriented for desired maximum roll back power and maximum dump speed.

SUMMARY OF THE INVENTION

According to the present invention, there is provided an improved self-leveling and tilt linkage arrangement for a front-end loader and more specifically there is provided an improved tilt cylinder mounting for such a linkage arrangement.

An object of the invention is to provide a self-leveling and tilt linkage arrangement wherein true leveling is accomplished for all positions of the tilt cylinder and the tilt cylinder is mounted to the leveling linkage in such a way as to accomplish desired maximum roll back power and maximum dump speed.

A further object of the invention is to incorporate a parallelogram-shaped plate assembly between leveling and tilt linkages at each side of the loader, with the plate assembly having adjacent lower central and front corners respectively coupled to the forward end of one loader arm and to an implement attachment bracket or carrier holder, and having adjacent rear and upper central corners respectively connected to the rear ends of a first set of parallel tilt links having their respective forward ends pivotally attached to the tilt cylinder, and to the forward end of a forwardly extending link of the leveling linkage and to provide a second tilt link extending between the tilt cylinder and the attachment bracket or carrier holder.

Yet another object of the invention is to provide a leveling and tilt linkage arrangement as set forth in the preceding object wherein the dump angle and roll back capabilities of the linkage remains constant for every height of the boom.

Still a more specific object of the invention is to provide a leveling and tilt linkage arrangement as set forth in the preceding object wherein a dump angle of about 90° and a roll back angle of about 40° may be achieved for all heights of the boom.

These and other objects of the invention will become apparent from a reading of the ensuing description together with the appended drawing.

DESCRIPTION OF THE PREFERRED EMBODIMENT

Figure 1:
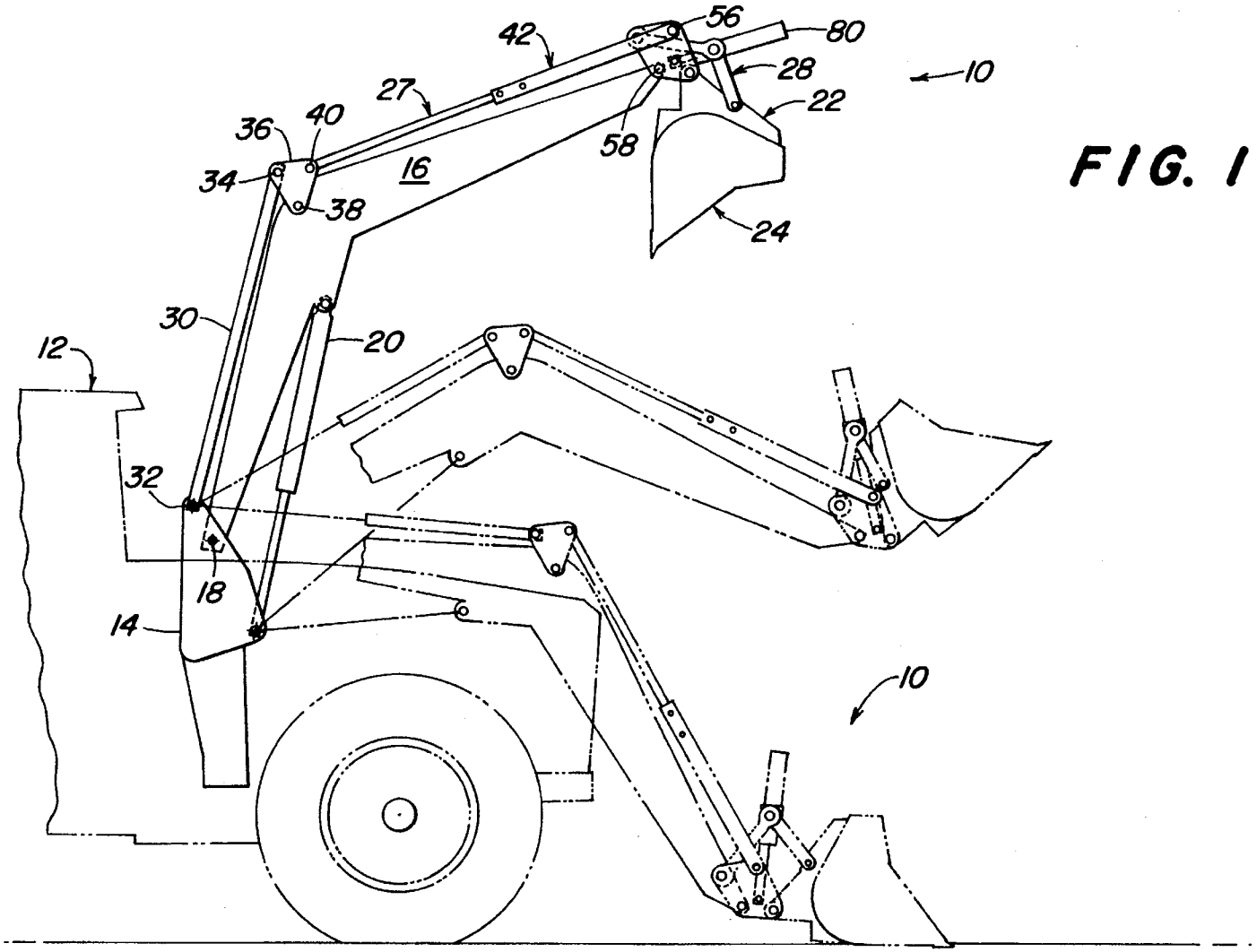
FIG. 1 is a somewhat schematic right side elevational view showing a front-end loader equipped with a bucket and with a parallelogram-shaped plate assembly being pivotally connected to one of the boom arms and a bracket at the back side of the bucket and interposed between the leveling and tilt linkages of the present invention, with the loader boom being shown in solid lines in a raised position with the bucket dumped, in dashed lines in an intermediate position with the bucket rolled back and in broken lines in a lowered position with the bucket level.

Referring now to FIG. 1, there is shown a front-end loader 10 mounted on a tractor 12, shown in outline fashion. The loader 10 includes right- and left-hand masts or posts (only the right-hand mast 14 is shown) disposed at opposite sides of and mounted to the frame of the tractor in a well known manner, not shown. A loader boom comprises parallel transversely spaced arms 16 located at opposite sides of the tractor and having their respective rear ends pivotally attached to the masts 14 by respective pins 18 spaced below top ends of the masts. Coupled between each mast 14 and each arm 16 is a hydraulic lift cylinder 20. A pair of transversely spaced brackets (only the right bracket 22 is shown) are fixed to the back side of an implement or attachment here shown as a bucket 24. In lieu of the brackets 22, a pair of transversely spaced, interconnected holders 25 (see FIG. 2) of an implement or attachment carrier 26 may be used. In either case, the pair of brackets 22 or holders 25 are respectively coupled to the forward ends of the pair of loader arms 16, in a manner described in more detail below. Coupled between the tops of the pair of masts 14 and to the pair of brackets 22 (FIG. 1) or holders 25 of the carrier 26 (FIG. 2) is a linkage train including a leveling linkage 27 and a tilt linkage 28.

Figure 2:
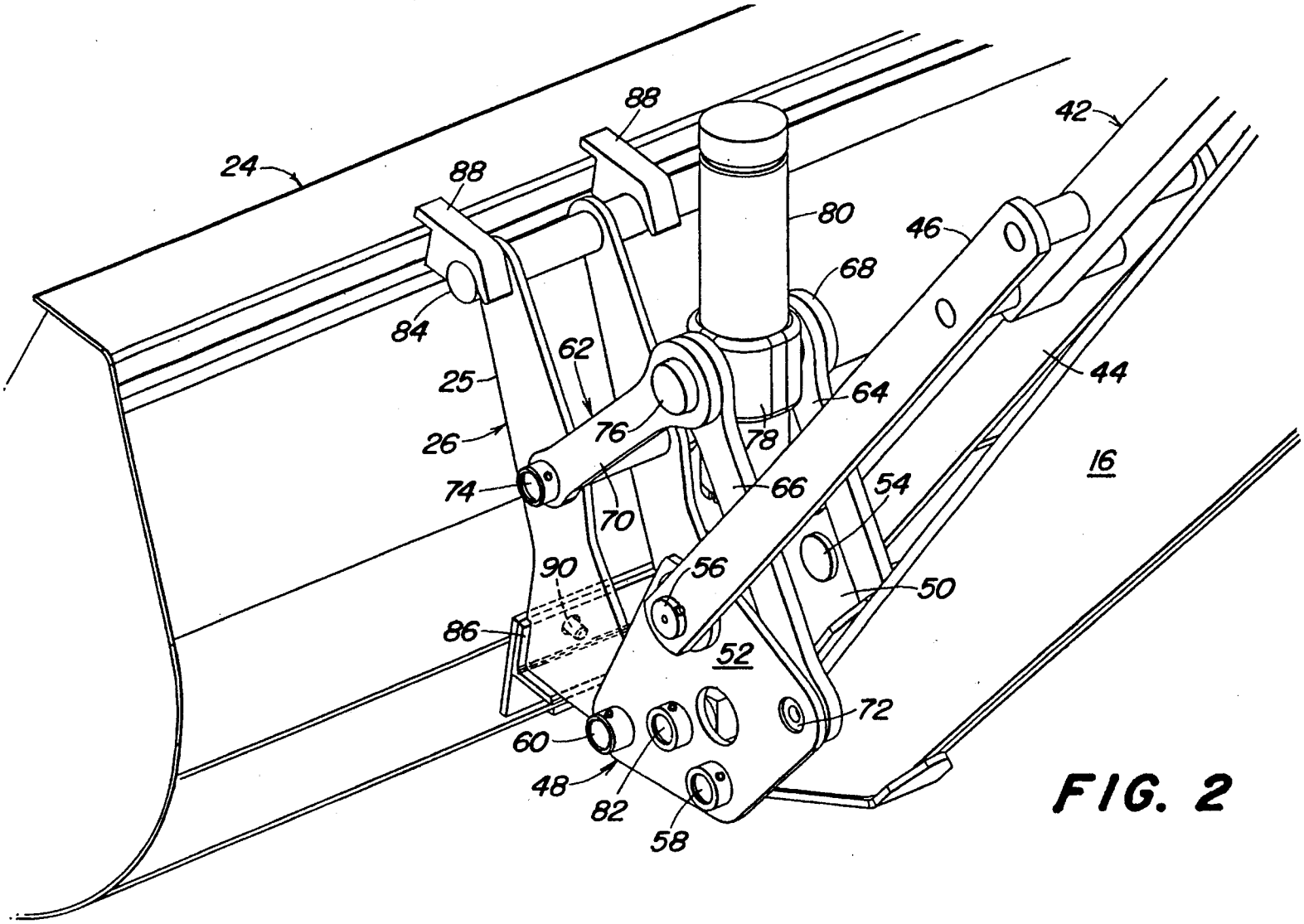
FIG. 2 is a left rear perspective view of the loader shown in FIG. 1 but showing the parallelogram-shaped plate assembly and tilt linkage at the left side of the loader coupled to a left implement carrier holder instead of to a bracket fixed to the back side of the bucket, the carrier holder being releasably attached to connections at the back side of a bucket.

Specifically, the leveling linkage 27 comprises a rear leveling link 30 having its rear end pivotally attached, as at pin 32, to the top of the mast 14 and having its front end pivotally attached, as at pin 34, to a rear corner of a knee plate assembly 36 comprising a pair of identical transversely spaced triangular plates, with a bottom corner of the assembly 36 being pivotally attached, as by a pin 38, to a bend or knee location of a respective boom arm 16. Referring now also to FIG. 2, it can be seen that a forward corner of the knee plate assembly 36 is connected, as at a pin 40, to a rear end of a front leveling link 42 including a bifurcated forward end section defined by right and left straps 44 and 46, respectively, disposed on opposite sides of a parallelogram-shaped plate assembly 48 comprising a pair of identical transversely spaced right and left plates 50 and 52, respectively, with the forward end of the right strap 44 being coupled, as at pin 54, to an upper center corner of the right plate 50, and with the forward end of the left strap 46 being coupled, as at a pin 56, to a corresponding upper center corner of the left plate 52. The plates 50 and 52 straddle and are coupled to the forward end of the loader boom arm 16 by a connection pin 58 extending through the plates at respective lower center corners. The forward ends of the spaced plates 50 and 52 of each parallelogram-shaped plate assembly 48 are disposed in straddling relationship to a respective one of the bucket brackets 22 (FIG. 1) or attachment carrier holders 26 (FIG. 2) and have their respective forward corners pivotally attached to a lower location of the bracket or holder by a pin 60.

The plate assembly 48 at one side of the loader serves as the connection between the leveling linkage 27 and tilt linkage 28 located on that side. Specifically, each tilt linkage 28 comprises right and left rear tilt links 64 and 66, respectively, and right and left front tilt links 68 and 70, respectively. The rear pair of tilt links 64 and 66 have rear ends disposed inside and pinned to respective rear corners of the parallelogram-shaped plates 50 and 52, with only a pin 72 coupling the plate 52 and link 66 being shown. The front pair of tilt links 68 and 70 have their front ends coupled to the adjacent bracket 22 or holder 25 by a pin 74. The front ends of the rear pair of tilt links 64 and 66 respectively overlap the rear ends of the front pair of tilt links 68 and 70 and are pivotally received on trunnions 76 projecting outwardly from a collar 78 welded to the barrel of a hydraulic tilt cylinder 80, the cylinder having a rod end located centrally between and pivotally coupled, as by a pin 82, to the plates 50 and 52 of the plate assembly 48.

As shown in FIG. 2, each carrier holder 25 is designed for being quickly coupled to a loader attachment and for that purpose a rod 84 extends between and through upper locations of the holders 25, the latter each having an angle member 86 welded to a lower forward corner and having an upright leg forming a lower forward abutment face, the upright leg being provided with a centrally located aperture. Provided at the back side of the bucket 24 for cooperating with the rod 84 joining the holders 25 at locations adjacent opposite sides of each holder 25 are a pair of downwardly opening hooks 88 snugly receiving the carrier rod 84, and a rearwardly projecting tapered pin 90 located in the apertured leg of angle member 86.

A brief description of the operation follows. Assuming the bucket 24 to be in its level condition with the boom arms 16 lowered, as shown in broken lines in FIG. 1, or as shown in FIG. 2, the bucket 24 may be lifted by extending the boom lift cylinders 20. During such lifting, the leveling linkage 27 will act to maintain a true level attitude of the bucket 24 due to the pivot points 18, 32, 34, and 38 describing a first true parallelogram and due to the pivot points 38, 40, 56 and 58 describing a second true parallelogram. With the attitude of the parallelogram-shaped plate assembly 48 remaining constant throughout the lift range of the boom, it will be appreciated that a full range of movement of the bucket 24 is possible for any position of the boom within its range of movement.

If desired, roll back may be accomplished by extending the cylinders 80 to cause the attachment points 72 and 74 to move toward each other with the result that the bucket 24 is tilted rearwardly about the pair of connection pins 60 respectively coupling the pair of brackets 22 (FIG. 1) or carrier holders 25 (FIG. 2) to the parallelogram-shaped plate assembly 48. In the intermediate position of the arms 16 shown in dashed lines in FIG. 1, the cylinders 80 are shown fully extended with the bucket 24 being rolled back about 43° to the horizontal to a full, rolled back position. Of course the bucket may be so rolled back in any position of the arms. In fact it is a common practice to roll back the bucket 24 while powering the tractor into a pile of material being moved in order to fill the bucket with such material. It is important to note that the power requirement for such a "break out" operation may be quite high and that the disposition of the tilt cylinders 80 is such that fluid pressure is routed to the cylinder 80 so as to act on the full area of the piston and generate maximum force for this operation. On the other hand, dumping of the bucket 24 requires substantially less power, due to the weight of the material aiding this motion, and is accomplished by retracting the cylinders 80 so that the bucket 24 rotates downwardly about the pin 60 connecting the bucket to the parallelogram-shaped plate assembly 48, the retraction of the cylinder occurring at maximum speed as is desired. The bucket 24 is shown in a fully-dumped position in the solid line raised position of the arms 16 shown in FIG. 1, this position illustrating a maximum dump angle of 90° to the horizontal. This position may be accomplished at any position of the arms 16 which is high enough to permit the bucket 24 to pivot downwardly about its connection with the plate assembly 48 without engaging the ground or an obstacle therebeneath.

We claim:

1. In a front-end loader including a pair of loader arms respectively pivotally coupled to a pair of masts for swinging vertically, a hydraulic lift cylinder connected between each mast and an adjacent arm for selectively raising and lowering the arm, an implement attached to forward ends of the arms for being raised and lowered together with the arms, a linkage train coupled between each mast and one of a bracket or carrier holder associated with the implement for maintaining the implement in a near level condition as the arms move between lowered and raised positions, said linkage train including leveling and tilt linkages and a tilt cylinder operable for selectively pivoting the implement to various attitudes relative to the horizontal, the improvement comprising: each linkage train including, as viewed from one side, a plate means having lower central, forward, upper central and rear points of connection arranged generally in the pattern of a parallelogram; a first pivot pin means at said lower central point of connection being pivotally coupled to the forward end of one of said pair arms; a second pivot pin means at the forward point of connection being pivotally coupled to a lower rear location of said one of said bracket or carrier holder; a third pivot pin means at the upper central point of connection-Being pivotally coupled to a forward end of a leveling link of said leveling linkage; a fourth pivot pin means at the rear point of connection being pivotally coupled to a rear end of said tilt linkage; a fifth pivot pin means coupling a forward end of said tilt linkage to said one of the bracket or carrier holder; and the hydraulic cylinder being connected between said plate means and tilt linkage.

2. The front-end loader defined in claim 1 wherein said plate means is parallelogram-shaped in side view and said points of connection being respectively located at respective corners of said plate assembly.

3. The front-end loader defined in claim 2 wherein said plate means is a plate assembly including a pair of identical, right and left, transversely spaced plates disposed in straddling relationship to the forward end of the associated loader arm.

4. The front-end loader defined in claim 3 wherein said tilt linkage includes a pair of identical, right and left, transversely spaced rear tilt links having their rear ends respectively located on facing sides of said right and left plates and having their forward ends respectively pivotally mounted to opposite sides of said hydraulic tilt cylinder.

5. The front-end loader defined in claim 4 wherein said rod end of the hydraulic tilt cylinder is located centrally between and pivotally connected to respective central zones of each of said pair of right and left plates; and said tilt linkage including a rear pair of tilt links having respective forward ends pivotally attached to a barrel of said tilt cylinder, and including a forward pair of tilt links having respective rearward ends pivotally attached to the cylinder barrel together with said forward ends of the rear pair of tilt links.

6. The front-end loader defined in claim 4 wherein said link of the leveling linkage has a bifurcated front end section defined by a pair of parallel, transversely spaced straps; and respective forward ends of said pair of straps being located on oppositely facing sides of said right and left plates.

7. The front-end loader defined in claim 1 wherein said implement is a bucket having a planar bottom surface and said tilt linkage and plate means are so arranged relative to each other and to said leveling linkage that full retraction of said tilt cylinder rotates said bucket downwardly about its connection with said plate means so as to dispose said planar bottom surface at a dump angle of about 90° to the horizontal.

* * * * *